United States Patent [19]

Ban et al.

[11] Patent Number: 5,076,771

[45] Date of Patent: Dec. 31, 1991

[54] SCROLL TYPE FLUID COMPRESSOR WITH LUBRICATED SPIRAL SEAL MEMBER

[75] Inventors: Takashi Ban; Tetsuhiko Fukanuma; Tetsuo Yoshida, all of Kariya, Japan

[73] Assignee: Kabushiki Kaisha Toyoda Jidoshokki Seisakusho, Kariya, Japan

[21] Appl. No.: 525,099

[22] Filed: May 17, 1990

[30] Foreign Application Priority Data

May 18, 1989 [JP] Japan ..... 1-57720[U]

[51] Int. Cl.[5] ..... F04C 18/04; F04C 27/00; F04C 29/02

[52] U.S. Cl. ..... 418/55.4; 418/55.6; 418/99; 418/142; 277/27; 277/71; 277/95

[58] Field of Search ..... 418/55.4, 55.6, 142, 418/99; 277/27, 71, 95

[56] References Cited

U.S. PATENT DOCUMENTS 4,561,832 12/1985 Shimizu ..... 418/55.4

FOREIGN PATENT DOCUMENTS 57-68579 4/1982 Japan ..... 418/55.4
58-98687 6/1983 Japan .
58-170872 10/1983 Japan ..... 418/55.6
59-185892 10/1984 Japan .
63-32181 2/1988 Japan ..... 418/55.4

*Primary Examiner*—John J. Vrablik
*Attorney, Agent, or Firm*—Brooks Haidt Haffner & Delahunty

[57] ABSTRACT

A scroll type compressor comprising a fixed scroll and movable scroll. The movable scroll revolves above an axis of the fixed scroll. Thus, a spiral portion of the movable scroll slides and moves relative to a spiral portion of the fixed scroll so as to compress a refrigerant gas between the spiral portions. A sealing member is mounted on the free end of each sealing member. The sealing member slides on a facing surface of the opposing scroll. An oil passage is provided in at least one of the scrolls. The oil passage opens at the rear surface of the sealing member and is able to supply lubricating oil to the rear surface. A constriction is provided in the oil passage. The constriction limits the flow of the lubricating oil towards the sealing member.

11 Claims, 3 Drawing Sheets

SCROLL TYPE FLUID COMPRESSOR WITH LUBRICATED SPIRAL SEAL MEMBER

The present invention relates generally to a volumetric fluid type compressing device, commonly referred to as a scroll-type compressor having a fixed scroll and a movable scroll. More particularly, it relates to an improved lubricating and sealing arrangement for the sliding contact portions of both scrolls.

BACKGROUND OF THE INVENTION

Scroll-type fluid compressors have a wide variety of applications. One common usage is in automotive air conditioning where a refrigerant gas is pressurized within the compressor and later evaporated to provide cooling.

Such compressors have a movable scroll member and a fixed scroll member. The movable scroll member has a scroll portion that is offset from and partially contacted with a scroll portion of the fixed scroll member so that sealed chambers are defined between the scroll members. The movable scroll is oscillated in a revolving manner under the influence of a cammed drive. Thus, as the movable scroll revolves, the sealed chambers are contracted towards the center of the scrolls so that the gases therein are compressed. In operation, refrigerant gases are introduced to a sealed chamber near the periphery of the scroll, as the scroll revolves, the sealed chamber "shifts" towards the center of the scrolls, thereby compressing the gases therein. The compressed gases are then discharged from the center region of the scrolls.

Generally, in scroll-type fluid compressors, it is considered important to assure that sliding contact portions of both the fixed and movable scrolls are sufficiently lubricated and sealed during use. For example, Japanese Laid-Open Patent Publications Nos. 59-185892 and 58-98687 disclosed prior art compressor designs.

In the former design, (Japanese Laid-Open Patent Publication No. 59-185892), an oil passage is provided in at least one of the scrolls. The oil passage communicates with an oil reservoir in the discharge chamber and has an opening at the distal surface of the spiral portion. A plurality of recesses are provided on the proximal wall of the opposing scroll. The recesses intermittently cause the oil passage to communicate with the compressing chamber at intervals synchronized with the revolutions of the movable scroll.

When the movable scroll is revolved, the oil passage and the recess intermittently allow the oil reservoir in the discharge chamber to communicate with the compressing chamber. At such times relatively large quantities of lubricating oil are transfered from the oil reservoir into the compressing chamber. This lubricating oil becomes mist and is, in an excessive amount, mixed with a refrigerant gas. When the compressed refrigerant gas is discharged into an external cooling circuit for circulation, the lubricating oil mist is also discharged into the cooling circuit and is circulated therewith. This lubricating oil tends to accumulate on the inner walls of the evaporator within the cooling circuit. The accumulated oils tend to reduce the amount of heat exchange in the evaporator, thereby reducing its efficiency.

In the latter design, (Japanese Laid-Open Patent Publication No. 58-98687), spiral shaped sealing members are provided along the distal surfaces of spiral portions of both the fixed and movable scrolls. These sealing members contact and slide across the proximal wall surface of the opposing scroll. A passage for pressure fluid is provided in at least one of the scrolls. The passage carries a pressurized fluid within the sealing member against the proximal wall of the opposing scroll.

Pressurized fluid is delivered to a recess in the distal surface of the scroll. The pressurized fluid is used to press the sealing member against the opposing wall in order to maintain a good fluid seal. A discharge passage is then provided to reduce the pressure of the pressurizing fluid at selected time.

Several sources are contemplated for the pressurizing fluid. The primary embodiment contemplates using the compressed refrigerant taken from a high pressure region between the scrolls. Alternatively, an external source may be used. It is also suggested that lubricating oil can be used as the pressurizing fluid. However, the described construction is unduly complicated since it requires periodic activation of a piston to reduce the pressurizing fluid pressure and when external supply sources are provided, a relatively complicated delivery structure would be required.

In the latter described design, when lubricating oil is used for a pressure fluid for pressing the seal member, a lot of lubricating oil is introduced into the compressing chamber via a fluid leading passage at revolutions of the movable scroll as well as the former. Accordingly, there is also the same problem that this lubricating oil is attached to the inner wall or the like of the evaporator in the cooling circuit and prevents heat exchange.

SUMMARY OF THE INVENTION

An object of the present invention is to provide a scroll type compressor, which can assure sufficient lubrication and sealing along the sliding contact portions of the fixed and movable scrolls. It is also an object of the invention to prevent the introduction of excessive amounts of lubricating oil into the compressing chamber when the movable scroll is being revolved.

In order to achieve the foregoing object, in the scroll type compressor of the present invention, sealing members of spiral shape are provided on distal surfaces of the fixed and movable scrolls. The sealing members contact and slide on a proximal wall of the other opposing scroll respectively. An oil passage is provided in at least one of the scrolls. This oil passage communicates with the oil supply source and opens at a rear side of the sealing member. A constriction is provided in the oil passage for limiting a flow of the lubricating oil.

Other and further objects of this invention will become obvious upon an understanding of the illustrative embodiments about to be described or will be indicated in the appended claims, and various advantages not referred to herein will occur to one skilled in the art upon employment of the invention in practice.

DETAILED DESCRIPTION OF THE PREFERRED EMBODIMENTS

First Embodiment

A first embodiment of a scroll type compressor in accordance with the present invention is described in detail hereinafter referring to FIGS. 1–4.

Figure 1:
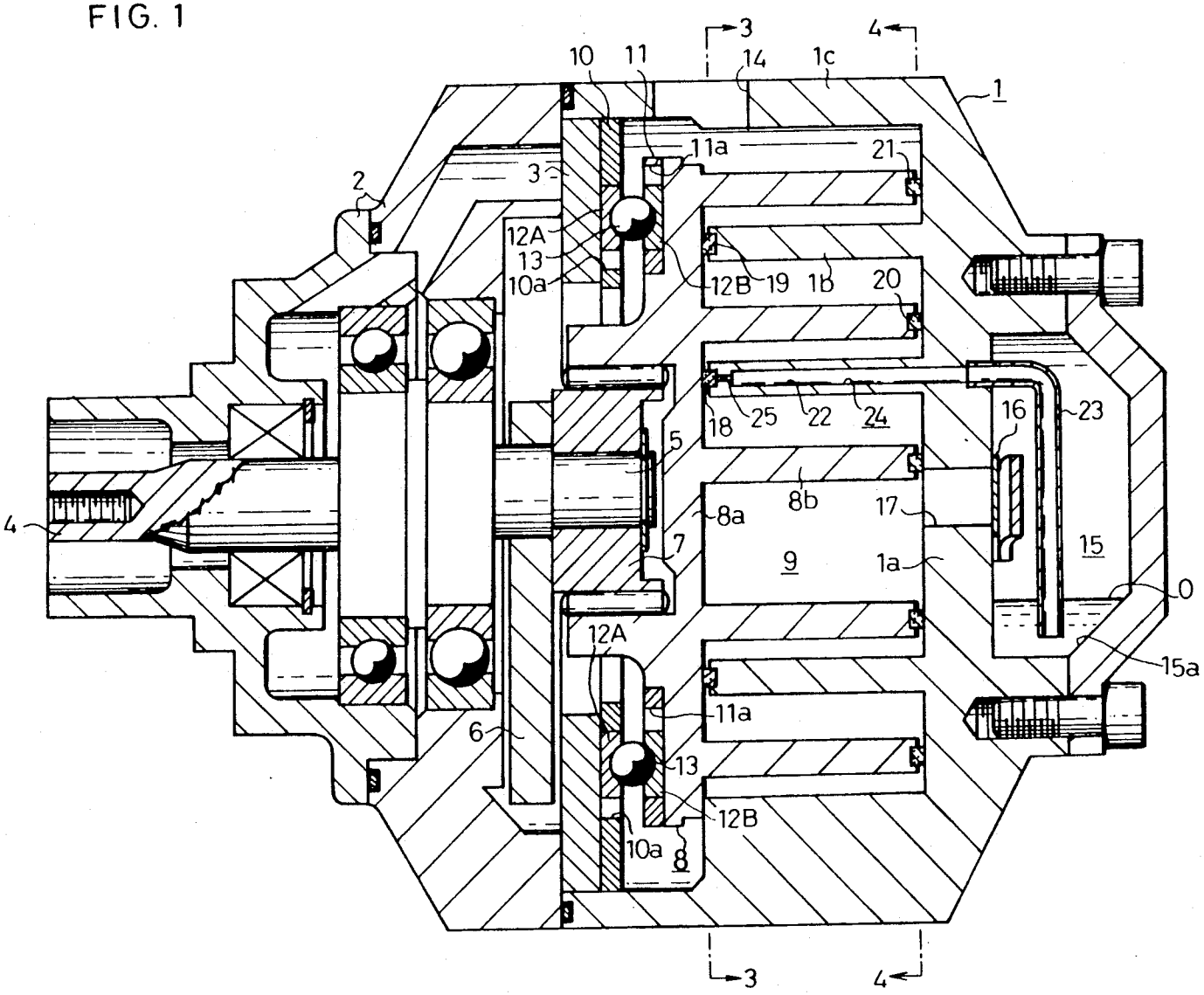
FIG. 1 is a sectional view showing a scroll-type compressor incorporating a first embodiment of the present invention.
Figure 2:
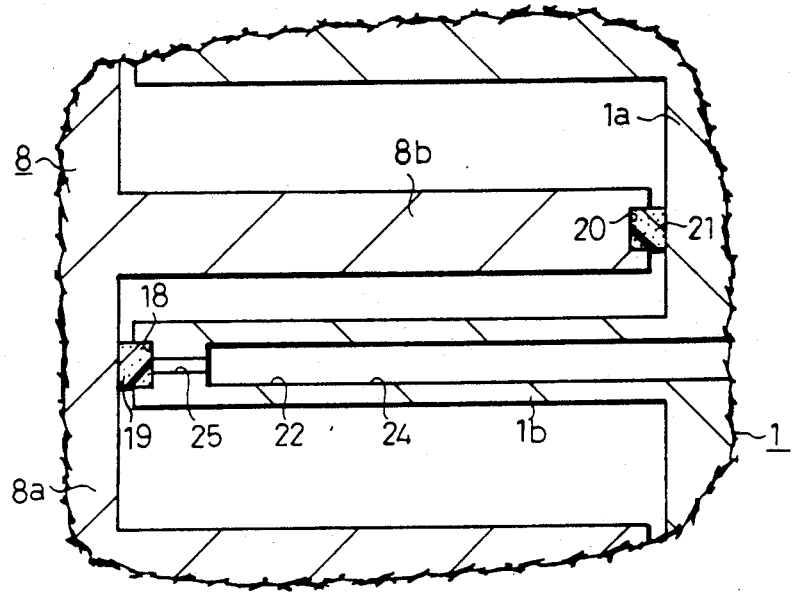
FIG. 2 is a partially enlarged sectional view highlighting the scroll contacting surfaces in the compressor shown in FIG. 1.

As shown in FIG. 1, a fixed scroll 1 has a proximal wall 1*a*, a spiral portion 1*b*, and an outer peripheral wall 1*c*. The outer peripheral wall portion of the fixed scroll 1 also forms the rear portion of the compressor housing. A front housing member 2 is coupled to an open end of the outer peripheral wall 1*c*. A ring shaped base plate 3 is inserted into and fixed to the open end of the outer peripheral wall 1*c* of the fixed scroll 1 and is joined to the front housing member 2. A rotatable drive shaft 4 is received and supported by the front housing member 2. An eccentric shaft 5 is projectingly coupled to an inner end surface of a large diameter portion of the shaft 4. A balancing weight 6 and a bushing 7 are supported by the eccentric shaft 5 so as to allow rotation relative to each other.

Figure 3:
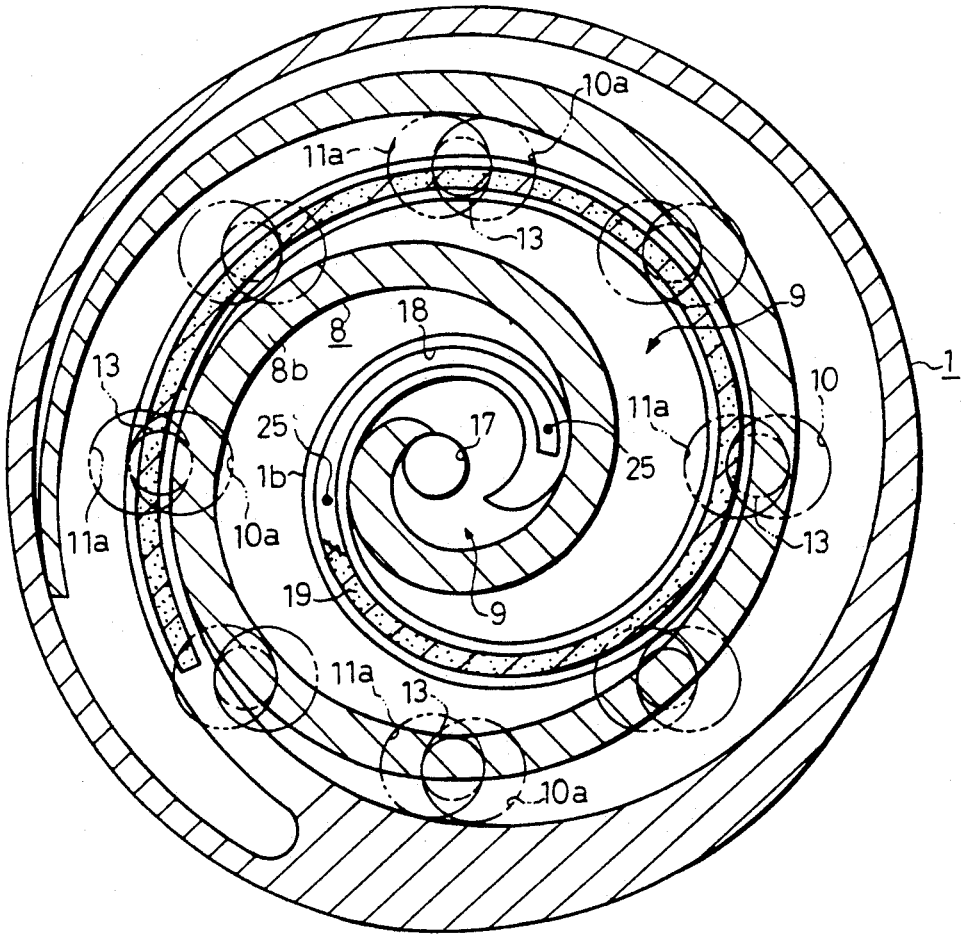
FIG. 3 is a cross-sectional view taken along a line 3—3 of FIG. 1.
Figure 4:
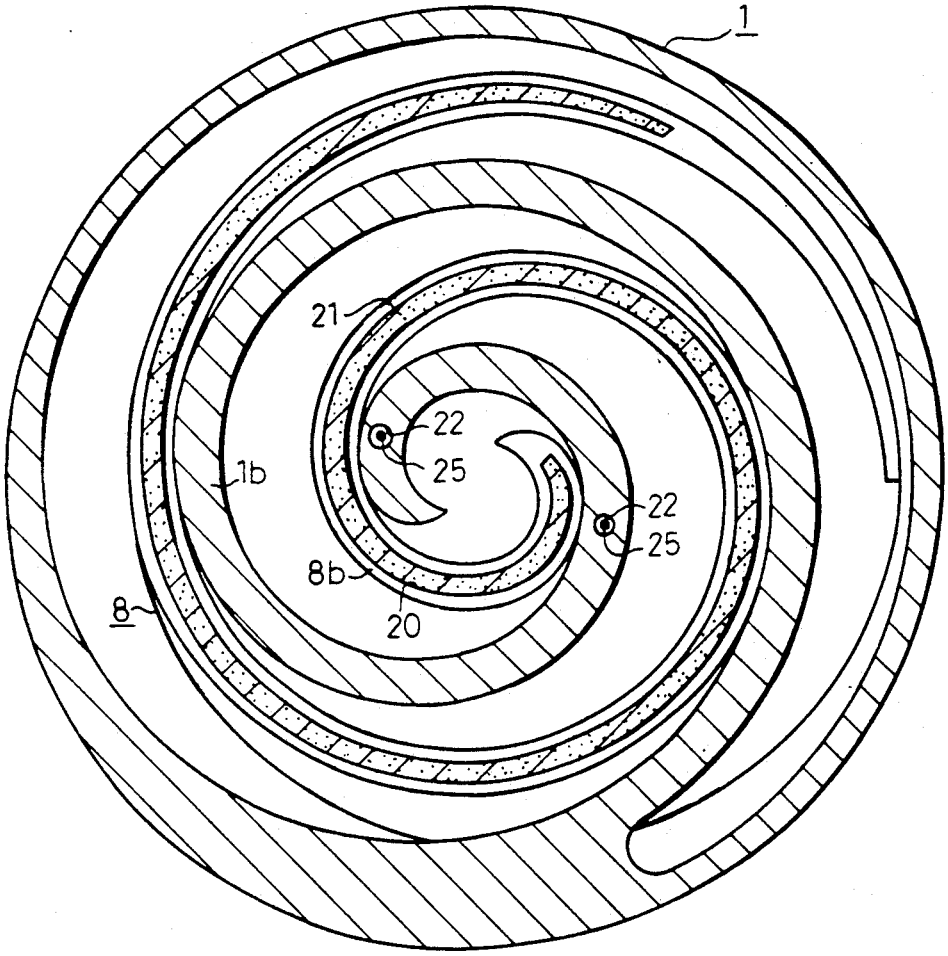
FIG. 4 is a cross-sectional view taken along a line 4—4 of FIG. 1.

A movable scroll 8 is rotatably supported on the bushing 7 so as to face and contact the fixed scroll 1. The scroll 8 has a proximal wall 8*a* and a spiral portion 8*b*. As shown in FIGS. 3 and 4, the spiral portion 8*b* of the movable scroll 8 contacts the spiral portion 1*b* of the fixed scroll 1 in at least two spaced apart regions. A compressing chamber 9 is thus defined by the proximal walls 1*a*, 8*a* and the spiral portions 1*b*, 8*b* of both the scrolls 1, 8 as the space between the contact regions.

A fixed ring 10 is fitted on the base plate 3 such that it faces the movable scroll 8. A plurality of circular holes 10*a* are formed in the fixed ring 10 at a predetermined intervals. A movable ring 11 is fitted on the rear surface of the proximal wall 8*a* of the movable scroll 8. A plurality of circular holes 11*a* are formed on the movable ring 11 at a predetermined interval corresponding to the spacing of the holes 10*a* in the fixed ring 10. Shoes 12A, 12B of the small diameter disc shape are inserted into each revolving position restricting holes 10*a*, 11*a* respectively. A ball 13 is held between each pair of the opposing shoes 12A and 12B.

Both the shoes 12A, 12B and the balls 13 are pressed and held between the fixed base plate 3 and the movable scroll 8 due to reaction against compression and seem to be integrated. The shoes 12A, 12B have movable areas of circular shape in the revolving position restricting holes 10*a*, 11*a*. Diameters of these movable areas are determined so as to correspond to the revolution radius of the eccentric shaft 5. Accordingly, as shown by chain lines in FIG. 3, all the shoes 12A, 12B are revolved along peripheries of the revolving position restricting holes 10*a*, 11*a* in accordance with revolution of the eccentric shaft 5 while being held between the revolving position restricting holes 10*a* and 11*a*. Thus, rotation of the movable scroll 8 is prevented, and only revolution thereof is allowed.

An inlet 14 is provided on the outer peripheral wall 1*c* of the fixed scroll 1 adjacent to the fixed ring 10 and to the movable ring 11. The refrigerant gas is introduced into the compressing chamber 9 between the scrolls 1 and 8 through this inlet 14. A discharge chamber 15 is formed on the outside surface of the proximal wall 1*a* of the fixed scroll 1. An oil sump 15*a* for storing oil is provided within the lower portion of the discharge chamber 15. The refrigerant gas is compressed in the compressing chamber 9 in accordance with the revolving motions of the movable scroll 8. The compressed refrigerant gas are then discharged through a passage 17 into the discharge chamber 15. The discharge valve 16 regulates the opening and closing of discharge passage 17.

A supporting groove 18 is spirally formed on the distal surface of the spiral portion 1*b* of the fixed scroll 1. The groove 18 extends along the entire length of the distal surface. A sealing member 19 is inserted into the supporting groove 18. The sealing member 19 is made of synthetic resin and extends along the entire length of the groove 18. A similar arrangement is provided on the distal surface of the movable scroll as well. That is, a second supporting groove 20 is formed along the entire distal surface of the spiral portion 8*b* of the movable scroll 8. A sealing member 21 also made of synthetic resin is inserted into the supporting groove 20. The sealing member 19 carried by the fixed scroll 1 contacts and slides along the proximal wall 8*a* of the movable scroll 8 as the movable scroll 8 is revolved. Similarly, the sealing member 21 carried by the movable scroll 8 contacts and slides along the proximal wall 1*a* of the opposing fixed scroll 1.

The sliding surfaces are lubricated by an oil delivery system that carries lubricating oil between the oil sump 15*a* and a pair of oil supply holes 22 are formed in the distal surface of the spiral portion 1*b* of the fixed scroll 1. One of the holes is located adjacent to the free end of the scroll. The second oil supply hole is positioned approximately 180 degrees away from the first relative to the axis of the rotatable shaft 4. Thus, the supply holes 22 each open adjacent to the rear surface of the sealing member 19. The oil delivery system includes an oil pipe 23 and an oil passage 24. The oil passage 24 extends longitudinally through the fixed scroll between each oil supply hole 22 and oil pipes 23. The oil pipe 23 is in fluid communication with the oil passage and extends to the oil sump 15*a* of the discharge chamber 15. A constriction 25 is formed in the oil passage 24 adjacent to a distal end of each oil supply hole 22. The constriction 25 limits the flow of lubricating oil O fed into the compressing chamber 9 through the oil delivery system.

Operations of the scroll type compressor of the foregoing construction are explained hereinafter.

Rotations of the drive shaft 4 cause the eccentric shaft 5 to rotate in a cam like manner. The shoes 12A and 12B follow the camming motion of the eccentric shaft 5. It is noted that the shoes are constrained to movements along the peripheries of the position restricting holes 10*a* and 11*a*. Therefore, the rotation of the movable scroll 8 is prevented. The resulting oscilating movement is referred to as revolving motion herein. As the movable scroll 8 revolves, the contacting portions of the spiral portions 1*b*, 8*b* of both the scrolls 1 and 8 move toward a center of the compressor to bring about compression. The compressed refrigerant gas is then discharged through the discharge passage 17.

When the movable scroll 8 is revolved, the lubricating oil O is delivered from the oil sump 15*a* into the compressing chamber 9 via the oil passage 24. The lubricating oil O is changed into mist and is mixed in the refrigerant gas, so that lubrication of contacting portions of the fixed and movable scrolls 1 and 8 can be achieved. The lubricating oil O in the oil passage 24 presses the sealing member 19 of the fixed scroll 1 against the proximal wall 8*a* of the opposing movable scroll 8. Thus, the sliding surfaces of both the scrolls 1 and 8 are securely sealed by means of the sealing member 19.

The constriction 25 in the oil passage 24 restricts the flow of the lubricating oil O to a certain extent. Therefore, the lubricating oil O is not introduced, in a large amount, from the oil sump 15*a* into the compressing chamber 9. As a result, excessive amounts of lubricating oil O are not mixed into the refrigerant gas. Thus, since lower quantities of lubricating oil mist are mixed with the refrigerant, less oil escapes into the external cooling circuit with the compressed refrigerant gas when the compressed refrigerant gas is discharged thereinto. Therefore, less oil is deposited on the internal walls of the evaporator in the cooling circuit, which in turn prevents degradation of the evaporator's efficiency.

Second and Third Embodiments

Figure 5:
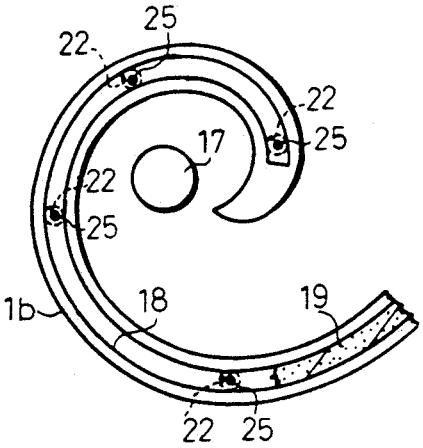
FIG. 5 is a cross-sectional view of the spiral portion of the fixed scroll of a second embodiment of the present invention.
Figure 6:
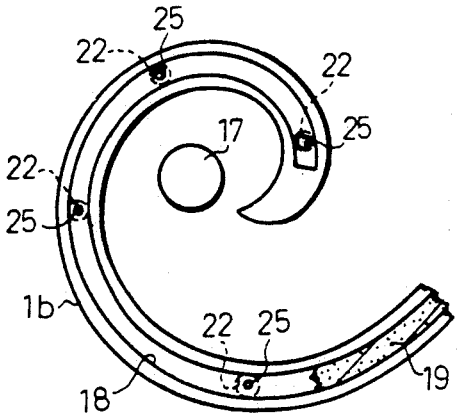
FIG. 6 is a cross-sectional view of the spiral portion of the fixed scroll of a third embodiment of the present invention.

Second and third embodiments of the present invention are described referring to FIGS. 5 and 6. These embodiments may be identical to the previously described embodiment except in the configuration of the oil delivery system.

According to the second embodiment shown in FIG. 5, four oil supply holes 22 are provided in the spiral portions 1*b* of the fixed scroll 1. The oil supply holes are arranged at approximately 90 degree intervals starting from a position adjacent to the free end of the spiral portion 1*b* of the fixed scroll 1. Each oil supply hole 22 has an oil passage 24 with a constriction 25 as described above. In this second embodiment, the lubricating oil O is supplied from the oil sump 15*a* into the compressing chamber 9 by means of four oil passages 24, so that the lubrication and sealing at the sliding surfaces of both the scrolls 1 and 8 can be improved even more.

In the third embodiment shown in FIG. 6, as well as the second embodiment, the oil leading holes 22 are provided at four locations of the spiral portions 1*b*. However, in this embodiment the constrictions 25 have varying diameters dependant on their locations on the fixed scroll. Specifically, the constrictions leading to oil delivery holes 22 disposed closer to the free end of the scroll have larger diameters than those closer to the fixed end of the scroll 1. At such locations, the compression pressure of the refrigerant gas increases. Thus, larger diameter constrictions are required to deliver the same amount of the lubricating oil O through each oil hole 22.

The present invention is not limited to the constructions of the foregoing embodiments. For example, the constrictions 25 can be formed in a wide variety of manners and locations. They may be placed at any location within the oil delivery system. Additionally, the delivery system may be formed without the oil supply pipe 23. For example, a vertical groove communicating between the oil hole 22 and the oil sump 15*a* can be formed on the proximal wall 1*a* of the fixed scroll 1. The oil leading passage 24 can also be located at other portions.

As many apparently widely different embodiments of this invention may be made without departing from the spirit and scope thereof, it is to be understood that the invention is not limited to the specific embodiments and examples provided herein, but rather is defined by the scope of the appended claims.

We claim:

1. A volumetric fluid compressor comprising:

a fixed scroll having a fixed base portion and a fixed spiral portion protruding from said fixed base portion, the fixed spiral portion having a distal surface;

a movable scroll having a movable base portion and a movable spiral portion protruding from said movable base portion, the movable spiral portion being interleaved with the fixed spiral portion to define a compression chamber therebetween and having a distal surface;

a discharge chamber for receiving pressurized gases compressed by the compressor, the discharge chamber having an oil reservoir therein;

a first sealing member carried by the distal surface of the fixed spiral portion, the first sealing member having a contact surface that slidably contacts a sliding surface on the movable base portion of the movable scroll, and a rear surface opposite the contact surface;

a second sealing member carried by the distal surface of the movable spiral portion, the second sealing member having a contact surface that slidably contacts a sliding surface on the fixed base portion of the fixed scroll, and, a rear surface opposite the contact surface;

lubricating means for lubricating the sliding surfaces of said fixed and movable scrolls, the lubricating means including an oil passage in fluid communication with the oil reservoir and extending through the spiral portion of one of said scrolls for delivering lubricating oil to the distal end of the selected scroll adjacent to the rear surface of its associated sealing member, the oil passage having therein a constricted first section and a second section wherein the constricted first section is opened toward a back side of the first sealing member and has a diameter less than a diameter of the second section for limiting the amount of oil delivered to the compression chamber.

2. A volumetric fluid compressor as recited in claim 1 wherein the lubricating means includes a plurality of oil delivery openings in the distal surface of the selected scroll.

3. A volumetric fluid compressor as recited in claim 2 wherein two oil delivery openings are provided and the oil delivery openings are spaced approximately 180 degrees apart.

4. A volumetric fluid compressor as recited in claim 2 wherein four oil delivery openings are provided and the oil delivery openings are spaced approximately 90 degrees apart.

5. A volumetric fluid compressor as recited in claim 2 wherein each oil delivery opening has an associated oil passage, each oil passage having a constricted first section and a second section and wherein the constricted first section has a diameter less than the diameter of the second section.

6. A volumetric fluid compressor comprising:

a fixed scroll having a fixed base portion and a fixed spiral portion protruding from said fixed base portion, the fixed spiral portion having a distal surface;

a movable scroll having a movable base portion and a movable spiral portion protruding from said movable base portion, the movable spiral portion being interleaved with the fixed spiral portion to define a compression chamber therebetween and having a distal surface;

a discharge chamber for receiving pressurized gases compressed by the compressor, the discharge chamber having an oil reservoir therein;

a first sealing member carried by the distal surface of the fixed spiral portion, the first sealing member having a contact surface that slidably contacts a sliding surface on the movable base portion of the movable scroll, and a rear surface opposite the contact surface;

a second sealing member carried by the distal surface of the movable spiral portion, the second sealing member having a contact surface that slidably contacts a sliding surface on the fixed base portion of the fixed scroll, and, a rear surface opposite the contact surface;

lubricating means for lubricating the sliding surfaces of said fixed and movable scrolls, the lubricating means including an oil passage in fluid communication with the oil reservoir and extending through the spiral portion of one of said scrolls for delivering lubricating oil to a plurality of oil delivery openings in the distal end of the selected scroll adjacent to the rear surface of its associated sealing member, the oil passageway having therein a constricted first section and a second section wherein the constricted first section is opened toward a back side of the first sealing member and has a diameter less than a diameter of the second section for limiting the amount of oil delivered to the compression chamber, the respective diameters of the constricted sections of the various oil passages increasing towards a central portion of the selected scroll.

7. In a volumetric fluid compressor having a fixed scroll and a movable scroll that cooperate to define a compression chamber that compresses gases therein as the movable scroll revolves relative to the fixed scroll, there being sliding surfaces on the fixed and movable scrolls, the improvement comprising:

a discharge chamber for receiving pressurized gases compressed by the compressor, the discharge chamber having an oil reservoir therein;

a sealing member carried by a distal end of the fixed scroll, the sealing member having a sliding surface that contacts a base portion of the movable scroll and a rear surface facing the fixed scroll;

lubricating means for lubricating the sliding surfaces of said fixed and movable scrolls, the lubricating means including an oil passage in fluid communication with the oil reservoir and extending through the fixed scroll for delivering lubricating oil to the distal end of the fixed scroll adjacent to the rear surface of the sealing member, the oil passage having therein a constricted first section and a second section and wherein the constricted first section has a diameter less than the diameter of the second section for limiting the amount of the oil delivered to the compression chamber.

8. A volumetric fluid compressor as recited in claim 7 wherein the lubricating means includes a plurality of oil delivery openings in the distal end of the fixed scroll.

9. A volumetric fluid compressor as recited in claim 8 wherein two oil delivery openings are provided and the oil delivery openings are spaced approximately 180 degrees apart.

10. A volumetric fluid compressor as recited in claim 8 wherein four oil delivery openings are provided and the oil delivery openings are spaced approximately 90 degrees apart.

11. In a volumetric fluid compressor having a fixed scroll and a movable scroll that cooperate to define a compression chamber that compresses gases therein as the movable scroll revolves relative to the fixed scroll, there being sliding surfaces on the fixed and movable scrolls, the improvement comprising:

a discharge chamber for receiving pressurized gases compressed by the compressor, the discharge chamber having an oil reservoir therein;

a sealing member carried by a distal end of the fixed scroll, the sealing member having a sliding surface that contacts a base portion of the movable scroll and a rear surface facing the fixed scroll;

lubricating means for lubricating the sliding surfaces of said fixed and movable scrolls, the lubricating means including an oil passage in fluid communication with the oil reservoir and extending through the fixed scroll for delivering lubricating oil to a plurality of oil delivery openings in the distal end of the fixed scroll adjacent to the rear surface of the sealing member, the oil passage having a constricted first section and a second section and wherein the constricted first section has a diameter less than the diameter of the second section, the respective diameters of the constricted sections of the various oil passages increasing towards a central portion of a scroll.

* * * * *

UNITED STATES PATENT AND TRADEMARK OFFICE

CERTIFICATE OF CORRECTION

PATENT NO. : 5,076,771

DATED : December 31, 1991

INVENTOR(S) : T. Ban

It is certified that error appears in the above-identified patent and that said Letters Patent is hereby corrected as shown below:

In the Abstract, line, 2, "above" should read "about".

Col. 1, line 29, "scroll" (first occurrence) should read --scrolls--.

Col. 6, line 28, after "and" delete comma ",".

Col. 7, line 18, after "and" delete comma ",".

Col. 8, line 50, delete "a", insert --the fixed--.

Signed and Sealed this

Thirteenth Day of July, 1993

*Attest:*

Michael K. Kirk

MICHAEL K. KIRK

*Attesting Officer*

*Acting Commissioner of Patents and Trademarks*